US010026268B2

(12) United States Patent
Gonyea

(10) Patent No.: US 10,026,268 B2
(45) Date of Patent: Jul. 17, 2018

(54) POKER-LIKE GUESSING GAME

(71) Applicant: Paul Gonyea, Royal Oak, MI (US)

(72) Inventor: Paul Gonyea, Royal Oak, MI (US)

( * ) Notice: Subject to any disclaimer, the term of this patent is extended or adjusted under 35 U.S.C. 154(b) by 18 days.

(21) Appl. No.: 15/200,905

(22) Filed: Jul. 1, 2016

(65) Prior Publication Data

US 2017/0186279 A1 Jun. 29, 2017

Related U.S. Application Data

(60) Provisional application No. 62/187,975, filed on Jul. 2, 2015.

(51) Int. Cl.

| | |
|---|---|
| ***A63F 9/24*** | (2006.01) |
| ***G07F 17/32*** | (2006.01) |
| ***A63F 1/00*** | (2006.01) |

(52) U.S. Cl.

CPC ..... *G07F 17/3293* (2013.01); *A63F 1/00* (2013.01); *G07F 17/3211* (2013.01); *G07F 17/3248* (2013.01); *G07F 17/3276* (2013.01); *G07F 17/3288* (2013.01); *A63F 2001/005* (2013.01)

(58) Field of Classification Search

None

See application file for complete search history.

(56) References Cited

U.S. PATENT DOCUMENTS

2007/0213111 A1* 9/2007 MacIver ..... A63F 13/10 463/9

2009/0054092 A1* 2/2009 Stonefield ..... G06Q 30/0601 455/466

* cited by examiner

*Primary Examiner* — Paul A D'Agostino

(74) *Attorney, Agent, or Firm* — John G. Posa; Belzer PC

(57) ABSTRACT

A poker-like guessing game uses an electronic device with a display and an audio generator to display a picture or play music for a predetermined period of time. The electronic device may be a smartphone, tablet computer or other portable electronic device. Participants bet that the players will—or will not—be able to identify the picture displayed or the music generated by the electronic device. The participants are rewarded when they bet correctly. Even if a player is able to identify the picture or sound, an object of the game is to fool or mislead the others (i.e., "bluff") with a poker face or other evasive tactic. A picture is displayed, or the music is played, for a short period of time, preferably in the range of a few or several seconds. Participants may select favored categories which the electronic device may or may not allow them to use in play.

14 Claims, 7 Drawing Sheets

Example of 4 People Playing

| Players Answer | People Betting | How Chips Are Distributed |
|---|---|---|
| Correct Answer | 3 guess right 0 wrong | All betters keep their bet and player collects pot. |
| Correct Answer | 2 right 1 wrong | 2 betters that guessed right keep their bet. Wrong guess forfeit bet to the pot. Player collects pot. |
| Correct Answer | 1 right 2 wrong | 1 better that guessed right keeps their bet. 2 wrong guesses forfeit bet to the pot. Player collects pot. |
| Correct Answer | 0 right 3 wrong | 0 betters keep bet. All 3 forfeit their bet to the pot. Player collects pot. |
| Wrong Answer | 3 right 0 wrong | Player loses turn. All 3 betters that guessed the player would guess right forfeit their bet to the pot. The pot continues to grow. |
| Wrong Answer | 2 right 1 wrong | Player loses turn. The 1 better that guessed player would guess wrong collects 1/2 of the other 2 bets. The other half goes into the pot. The pot continues to grow. |
| Wrong Answer | 1 right 2 wrong | Player loses turn. Better that guessed right loses 1/2 of their bet to the pot. The other half is split between the 2 people that guessed the player would guess wrong. |
| Wrong | 0 right 3 wrong | Player loses turn. All 3 betters keep their bet & pot is divided between betters. |

*Fig - 7*

POKER-LIKE GUESSING GAME

REFERENCE TO RELATED APPLICATION

This application claims priority from U.S. patent application Ser. No. 62/187,975, filed Jul. 2, 2015, the entire content of which is incorporated herein by reference.

FIELD OF THE INVENTION

This invention relates generally to games and, in particular, to a poker-like guessing game wherein players or teams bet that they can bluff or fool the other players.

BACKGROUND OF THE INVENTION

Poker is one of the most popular gambling card games, with a rich and interesting history. It is believed that the game originated in Persia and was then passed along to French settlers in New Orleans by Persian sailors. Europeans called the game "poque," a French term derived from the German term "pochen" which means to knock. However, while the origins of poker probably lie in Europe and Persia, the game blossomed in popularity in the United States, particularly when American gambling moved from frontier towns to riverboats.

Although gambling was tolerated in the Southwestern frontier during the early 1800's, people became less tolerant by the mid nineteenth century. As tolerance diminished, ordinances were passed against gambling, and many towns expelled known gamblers. This caused many gamblers to resort to steamboats navigating the Mississippi river. Carrying heavy gambling equipment like roulette wheels was difficult aboard the steamboats, but the cards used to play poker are light weight and portable. As the popularity of poker grew, at some point the deck of cards was increased from 20 to 52 cards.

Many different poker variations were introduced in the mid nineteenth century, including draw poker, stud poker (the five-card variant), and straight poker. The 'wild card' was introduced in 1875, lowball and split-pot poker came up in the 1900s, and community card poker games emerged in 1925. The popularity of the game slowly spread to other countries, particularly Asia mainly due to influence of the U.S. military.

Years ago poker was played by cheats and outlaws on riverboats. Today it is a celebrated 'sport' played worldwide by professionals, some with a celebrity status. Modern technology has also taken things further, and poker can now be played using software programs that connect millions of players across the globe. The term 'poker' can now refer to video poker, a single-player game seen in casinos much like a slot machine, or to other games that use poker hand rankings. Despite all of these developments, there will always be room for other games based strongly or loosely on the game of poker.

SUMMARY OF THE INVENTION

This invention resides in a poker-like guessing game and associated methods of playing the game based upon certain rules. The game is intended for a plurality of participants which may be individuals or groups. The game uses an electronic device with a display and an audio generator to display a picture or play music for a predetermined period of time. The electronic device may be a smartphone, tablet computer or other portable electronic device.

The participants bet that the players will—or will not—be able to identify the picture displayed or the music generated by the electronic device. The participants are rewarded when they bet correctly. If a player is able to identify the picture or sound, that player does not want the other participants to know it. Instead, an object of the game is to fool or mislead the others (i.e., "bluff") with a stern poker face or whatever other evasive tactic. Even if a player knows the correct answer, they may choose to "check" to a longer round of betting to lure the others to bet against them. The players have about 30 seconds, more or less, to check or guess.

A picture is displayed, or the music is played, for a short period of time, preferably in the range of 1 to 20 seconds. More preferably, the pictures or sounds are generated for a several seconds such as 7 seconds or less. However, following checking, the pictures or sounds may be generated for longer periods of time such as 11 seconds or more. For very advanced players, pictures or sounds may only last a few seconds, even 1 second or less.

The preferred embodiment includes choosing, by the participants, favored categories of pictures or music. A deck of cards may be provided with categories of pictures and music chosen by a player for guessing purposes, with the electronic device displaying a picture or playing music based upon the category of the chosen card.

As with other gambling games, chips may be provided for betting purposes. The player with the most chip count at the end of the predetermined number of turns "wins." A player is out of the game if they run out of chips.

BRIEF DESCRIPTION OF THE DRAWINGS

FIG. 7 is a table that shows how bets may be distributed based on four people playing the game.

DETAILED DESCRIPTION OF THE INVENTION

This invention resides in a game and associated application ("app") intended for execution on any portable electronic device such as a smartphone or tablet computer. Alternatively the app may be played on a less-portable device such as smart TV or wall monitor. The game may have the feel of Texas Hold'em, Poker, or Blackjack, except that it is not played with a deck of standard playing cards. Rather, participants bet on other players correctly guessing answers to questions drawn from certain categories, rather than if a player has 4 of a kind, a fill house, a straight, and so forth.

The game may be played by individuals or groups. In this disclosure, "player" should be taken to mean a person or a group acting together as a player. Further, the opponents of a player are herein referred to as "betters." The players and betters are collectively referred to as "participants."

The primary categories for this particular game include music, people and places. However, the game can be played by betting and then bluffing against other people's knowledge of an unlimited number of categories, including, for example: historic/classic automobiles, U.S. and world cityscapes, breeds of dogs and cats, identifying flags of world countries, pictures of animals from various continents, even trees and flowers. While the game is intended to be entertaining, it is also educational in the sense that participants may learn things about the subjects of the categories. Indeed, categories may be developed for more educational purposes such as books, paintings, foreign alphabets, words and phrases; sign language, and so forth.

The game centers on the idea that a bet can be made and a bluff can be made-about nearly anything. As such, the invention is not limited in terms of underlying subject matter. The game uses poker chips, drawing cards that give directions, and decision cards in conjunction with an app that runs on an electronic device with a display. Complete instructions, provided in the boxed game, instruct the user how to download the app from a play store for free downloading. The game is designed for ages 12 and up, and for 4-10 players, to play individually or to be split into groups of 2 or 3 people.

Figure 1:
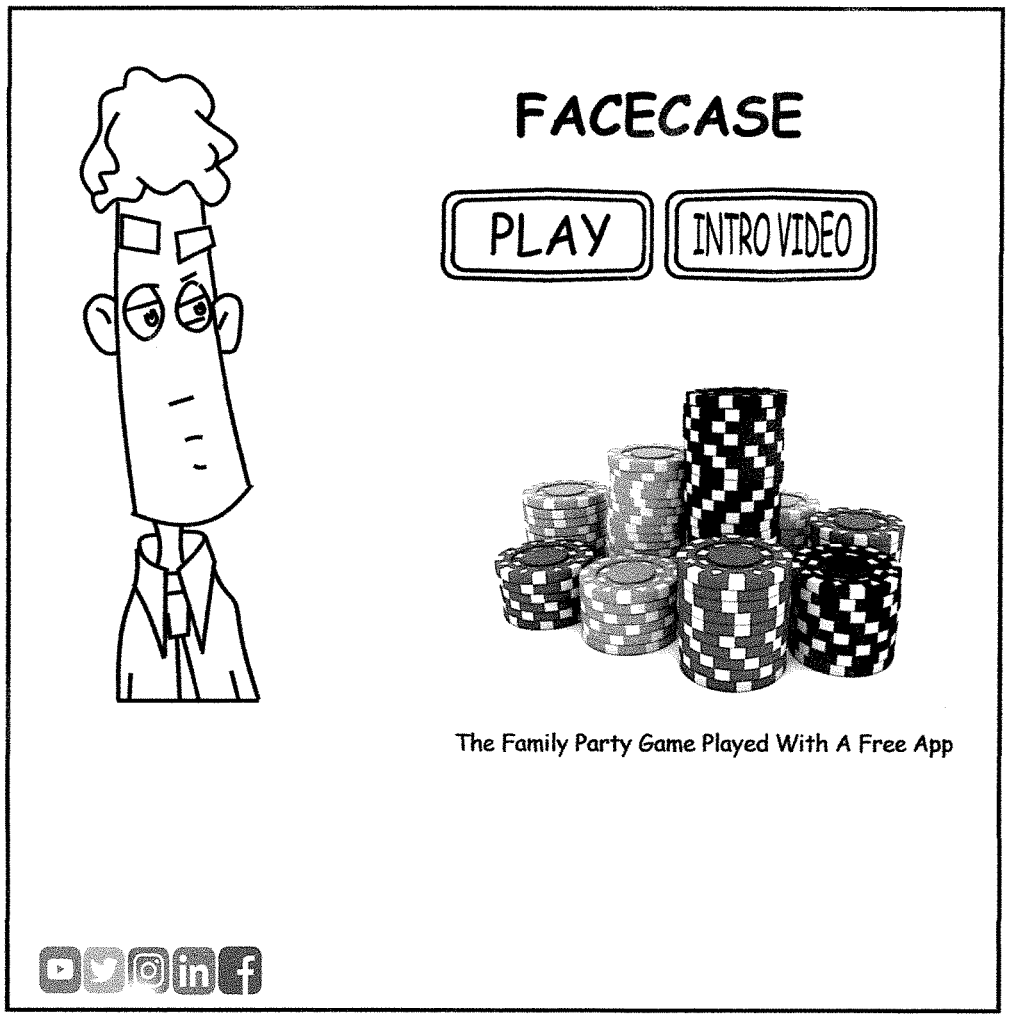
FIG. 1 is an initial screen display with the app installed.
Figure 2:
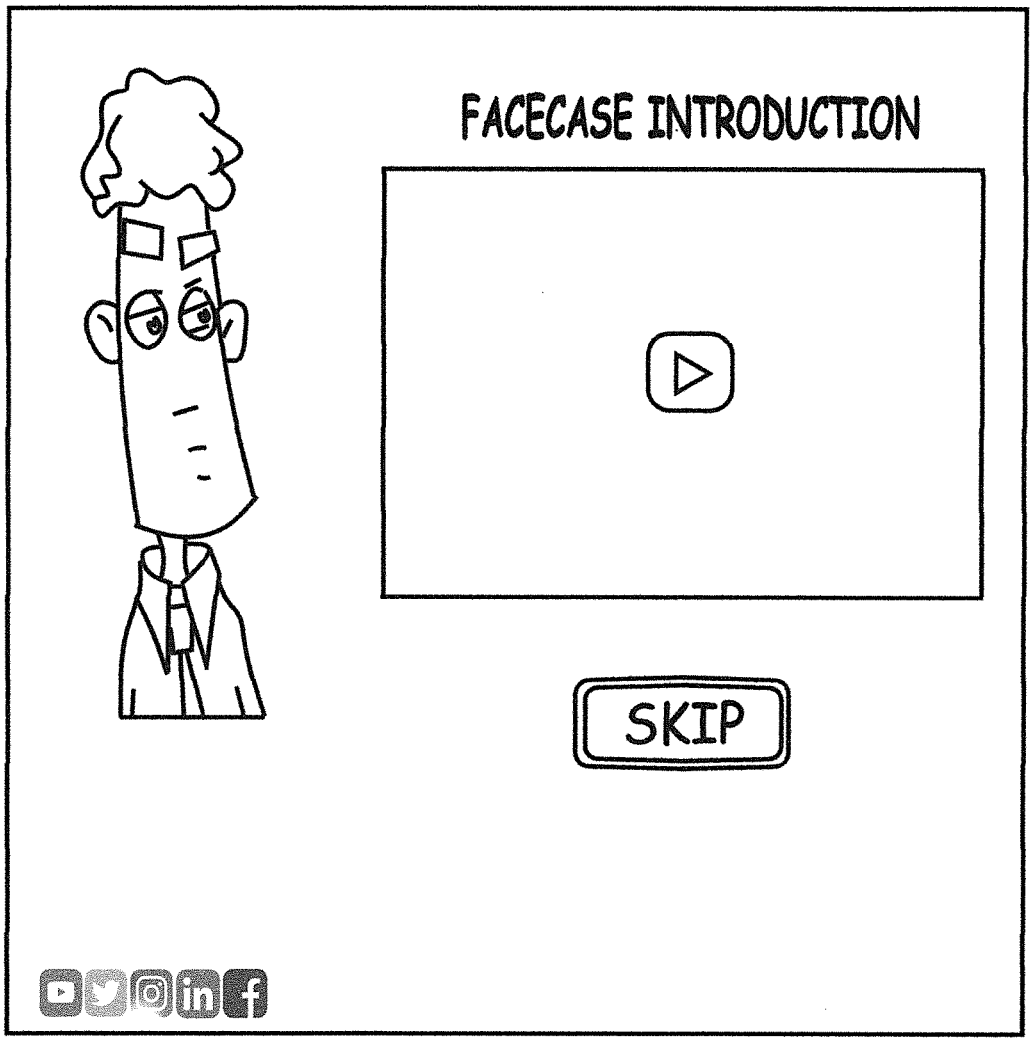
FIG. 2 shows an introductory screen to PLAY or SKIP the introductory video.

FIG. 1 shows the initial screen of the device with the app installed. All participants should position themselves to be able to see the screen, sometimes turning the device to orient the screen. An Icon offers a 3-minute video explaining details of how the game is played. A SKIP icon will be offered for those who already know how to play. FIG. 2 shows an introductory screen to PLAY or SKIP the introductory video.

Figure 3:
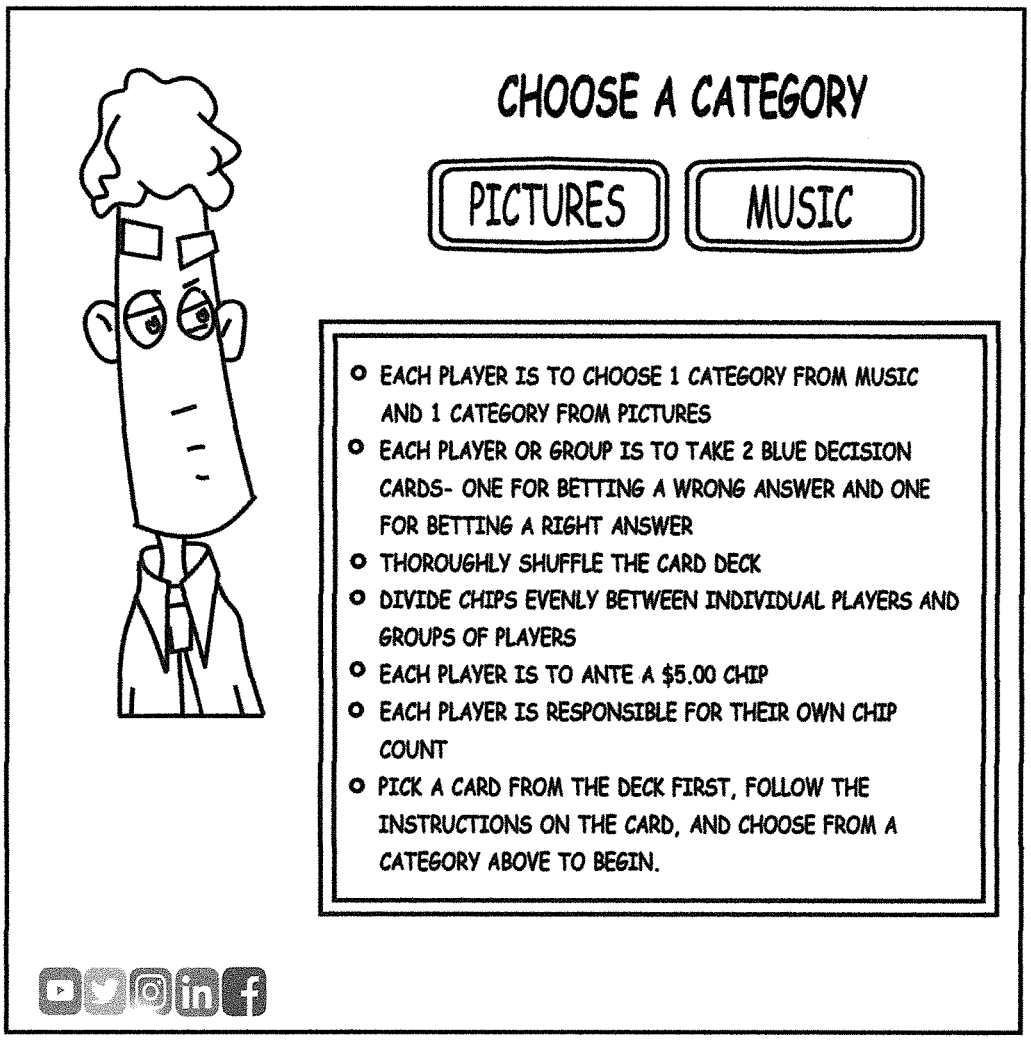
FIG. 3 illustrates a HOME page with instructions before playing.
Figure 4:
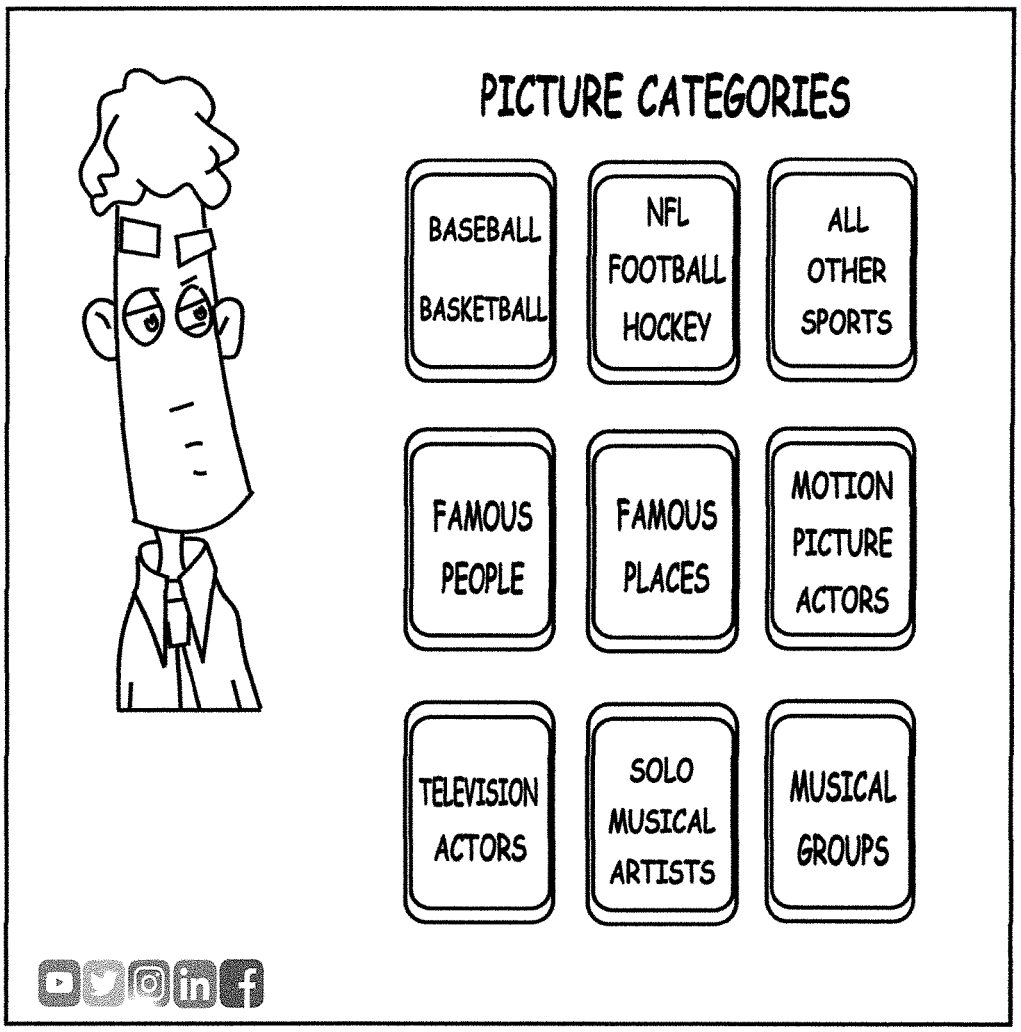
FIG. 4 illustrates nine typical PICTURE categories.
Figure 5:
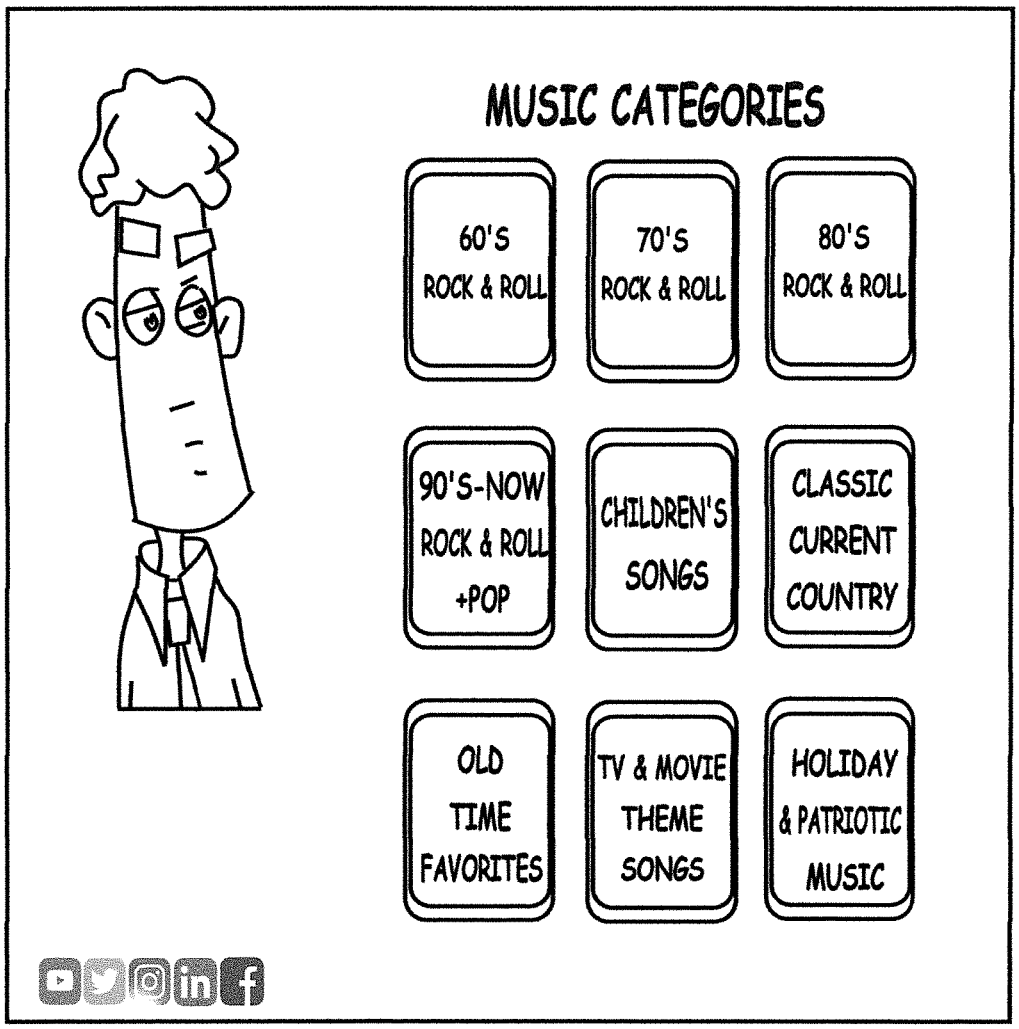
FIG. 5 shows nine representative MUSIC categories.

FIG. 3 illustrates a HOME page with instructions before playing. As noted, each player is to choose one category from MUSIC and one category from PICTURES. FIG. 4 illustrates nine typical PICTURE categories; FIG. 5 shows nine representative MUSIC categories. It should be evident that more or less than nine categories may be presented, and that the categories shows in the drawings are merely representative, and may be different and/or change over time.

The titles of the category buttons should largely speak for themselves. For example, in the PICTURE categories, the FAMOUS PEOPLE and FAMOUS PLACES icons provide 50-100 pictures of famous people or famous places taken from multiple categories. During play, the pictures will fade in and out or flash around the screen for 7 to 11 seconds. Each MUSIC category will contain between 50-100 short (i.e., 7 to 11 second) excerpts of music, chosen from Billboards top songs from over the years, drawn from the public domain or purchased with a mechanical license.

Each participant now chooses its favorite two icons, one from MUSIC and one from PEOPLE/PLACES. For example, for MUSIC, a player/group may choose '60s rock & roll, '70s, rock & roll, or country music. In PEOPLE/PLACES, each player, for example, may choose sports, famous people (such as U.S. Presidents, world religious leaders or business leaders) television actors, famous places, etc. Each participant writes down their choices to avoid any confusion as to which selections have been chosen later in the game. These two icons represent the personal favorite for each participant to make their guesses easier and, hopefully—to give them "an edge."

FIG. 3 illustrates further instructions prior to play. Chips are provided, which are divided equally among the players/groups. Each player or group is responsible for their own chip count. Each player will be responsible for an ante to the pot (i.e., $5.00 in chips) as the play begins. In advance of starting, the players also agree on the number of turns to be taken by each player; for example, the length of the game can be 10, 15, or 20 turns each or whatever the players decide, depending on how long they want the game to last. The player with the most chip count at the end of the predetermined number of turns "wins." A player is out of the game if they run out of chips. Note that in schools or educational environments, an option would be to use points or a different betting system rather than using poker chips to play down the gambling aspect of the game.

Figure 6:
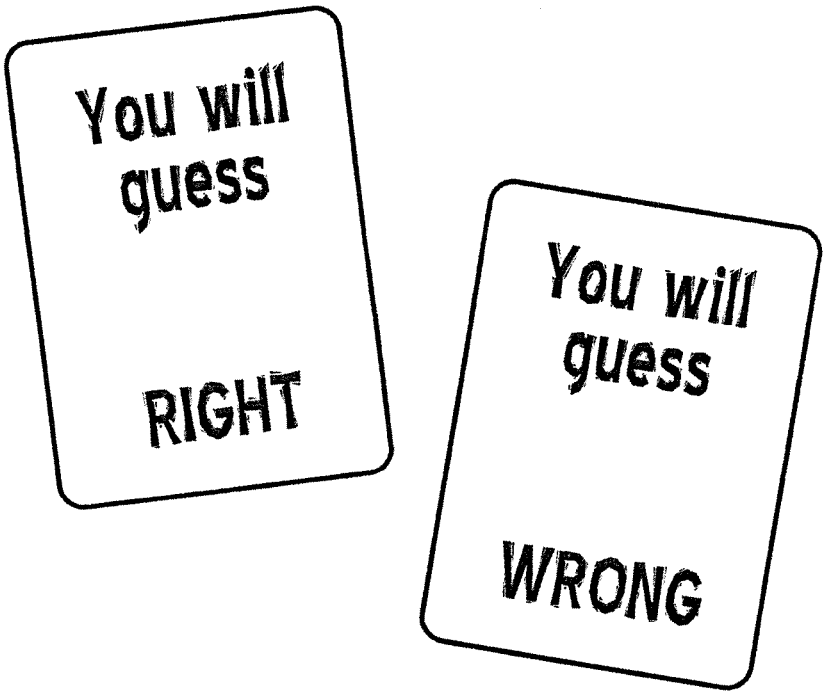
FIG. 6 depicts two types of decision cards.

Each player has 2 decision cards, shown in FIG. 6. One card states that a player will not guess the right answer. The other states that the player will guess it correctly. The decision cards are not displayed until bets are made and they are placed face down in front of the person betting.

The first player draws from a stack of cards which are described in further detail herein. There will be a well-shuffled stack of cards for the table to draw from when it is their turn. The cards will be stacked face down, so each player makes a blind draw when it is their turn. The cards are preferably about the size of an ordinary deck of cards, and will all have the same appearance on the back side to ensure a blind draw.

The percentage of MUSIC and the PEOPLE/PLACES cards will be broken down as follows:

23% take your normal MUSIC turn;

23% take your normal PEOPLE/PLACES turn;

54% directing player to go to a specific icon.

The following are some examples of how the cards will read, and how to direct players to take their turn:

MUSIC:

"Are you a 60's hippie?"—Choose the 60's rock & roll icon;

"Santa and Rudolph says"—Choose the Holiday icon;

"For some twangy guitars"—Choose the Country icon;

"Can you dig it? Awesome baby!"—Choose the 70s category;

PEOPLE/PLACES:

"You're in the penalty box"—Choose the sports icon that includes hockey;

"Go ahead, make my day"—Choose the Hollywood icon;

"Pray for an easy picture to identify"—Choose the Famous People category (which includes World Religious Leaders);

"Ask not what your country can do for you but what you can do for your country"—Choose the Famous People category (which includes U.S. Presidents).

Picking Cards and Playing the Game

The card will either say TAKE YOUR CHOSEN MUSIC TURN, TAKE YOUR CHOSEN PEOPLE/PLACES TURN, or the player will be directed to go to a specific icon. If the player is instructed to choose from a specific icon (either MUSIC or PEOPLE/PLACES) the card may say, for example, FIRST DOWN AND TEN YARDS TO GO—CHOSE THE SPORTS ICON. The player must then choose the sports icon. The player will then press the Icon on the portable electronic device to start the music or show a picture of a famous person/place.

When the Icon is pressed, a musical song will play, or a picture of a famous person or place will be displayed. These presentations will last for a short period of time, such as 7 seconds. That is, the music will play for 7 seconds, then end. Some pictures of the "general era" could appear on the screen as the music plays. If a picture is chosen, the picture will fade in and out for 7 seconds on the screen or the picture will appear for 2 or 3 seconds in different parts of the device, fading or flashing in and out.

This is the point in the game where a "poker face" is important. If a player knows the answer, that player does not want the other participants to know it. Instead, an object of the game is to fool or mislead the others with a stern poker face or whatever other evasive tactic. This is the crux of the game—to bet, bluff and fool the other participants. Even if a player knows the correct answer, they may choose to "check" to a 11-second round to lure the others to bet against them. The players have about 30 seconds, more or less, to check or guess.

1) Every better must first ante a minimum amount (such as $5) before play begins;

2) Each better may then bet up to the decided maximum (i.e., $25). These chips are kept separate from the pot;

3) The current player now says "guess" or "check."

4) Betters display their decision card for betting for or against the other player's guesses.

If the player chooses to guess, the guess icon will be pressed and the answer will be displayed. With MUSIC, the name of the song or artist can be guessed. The person's name or name of a place is guessed if a picture (again, with reasonable pronunciation).

If a player's guess is correct, that player collects all the bets and pot except people that bet that the player would guess right based upon their decision card. Those players keep their bet, except their ante. If a player's guess is incorrect, the player loses their turn and all the betters' bets are kept except betters whose decision cards indicated that the player would guess correctly. Those betters forfeit ½ of their bet to the pot. The other half is divided among the betters that guessed the player would guess wrong. Ante money is not returned, and the pot continues to grow.

If the player chooses to check, play enters a 11-second round and the decision cards remain unturned. The player must match the highest bet currently on the table before the 11-second round can be played. Any double-down bets can also be made.

For the 11-second round, the same song is played or the same picture is displayed, but for a longer period of time. Now the player must guess the artist or title of song or identify person or place (with reasonable pronunciation). Players can DOUBLE DOWN on this final 11 seconds. After the 11 seconds, the decision cards are displayed. If the player guesses wrong, the player loses their turn and the betters keep their bets (except those that said the player would guess wrong). The betters who decided that the player would guess right forfeit ½ of their bet to the "pot," and the other half is divided among the betters deciding that the player would guess wrong. On a correct guess, the player collects all the bets and pot, except those betters that bet that the player would guess correctly. Those betters get to keep their bets. FIG. 7 shows how bets are distributed based on four people playing.

As an option, a player may PASS IT ON to the group to guess instead (in the 11-second round only), starting with the participant on their right. If someone from the group guesses correctly, the participant that guessed collects the pot. If someone guesses incorrectly, the participant that passed it on collects the pot. If no one wants to guess, the player that initially passed it on collects a predetermined amount (i.e., $25) from all participants. At no time can a wrong guess be rewarded.

The invention claimed is:

1. A method of playing a game involving a plurality of participants, comprising the steps of:

providing an electronic device with a display and an audio generator;

providing customized a deck of cards presenting categories of pictures and music;

choosing one of the cards by a player of the game;

providing and executing an application program on the electronic device causing the electronic device to display a picture or play music for a predetermined period of time based upon the category of the card chosen by the player;

betting, by the other participants, that the player will, or will not, be able to identify the picture displayed or the music generated by the electronic device; and rewarding participants who bet correctly.

2. The method of claim 1, wherein the predetermined period of time is 1 to 20 seconds.

3. The method of claim 1, including the step of choosing, by the participants, desired categories of pictures or music.

4. The method of claim 1, wherein each participant may be an individual player or a group of individuals.

5. The method of claim 1, including the steps of:

providing chips representing monetary values; and using the chips to bet.

6. The method of claim 1, including the steps of:

adding an additional round of betting; and wherein the picture or sound is generated for an increased predetermined period of time.

7. The method of claim 1, including the steps of allowing players to pass the identification of the picture or music to other players.

8. A game involving a plurality of participants, comprising:

an electronic device with a display and an audio generator;

a customized deck of cards presenting categories of pictures and music;

an application program executed on the electronic device causing a picture to be displayed, or music to be generated for a predetermined period of time based upon the categories of pictures and music chosen with the cards;

wherein the participants of the game bet that players will or will not be able to identify the picture displayed or the sound generated by the electronic device.

9. The game of claim 8, wherein the electronic device is operative to play the music for 1 to 20 seconds.

10. The game of claim 8, wherein the electronic device is operative to display the picture for 1 to 20 seconds.

11. The game of claim 8, wherein the participants choose desired categories of pictures or music.

12. The game of claim 8, wherein each participant may be an individual player or a group of individuals.

13. The game of claim 8, including chips representing monetary values for use for betting.

14. The game of claim 8, wherein the electronic device is a smartphone, tablet computer or other portable electronic device.

* * * * *